US011352678B2

(12) United States Patent
Fröhlich et al.

(10) Patent No.: US 11,352,678 B2
(45) Date of Patent: Jun. 7, 2022

(54) METHOD FOR COLD DEFORMATION OF AN AUSTENITIC STEEL

(71) Applicant: Outokumpu Oyj, Helsinki (FI)

(72) Inventors: Thomas Fröhlich, Ratingen (DE); Stefan Lindner, Willich (DE); Thorsten Piniek, Krefeld (DE)

(73) Assignee: Outokumpu Oyj, Helsinki (FI)

( * ) Notice: Subject to any disclaimer, the term of this patent is extended or adjusted under 35 U.S.C. 154(b) by 362 days.

(21) Appl. No.: 16/337,619

(22) PCT Filed: Sep. 29, 2017

(86) PCT No.: PCT/EP2017/074832
§ 371 (c)(1),
(2) Date: Mar. 28, 2019

(87) PCT Pub. No.: WO2018/060454
PCT Pub. Date: Apr. 5, 2018

(65) Prior Publication Data

US 2019/0345575 A1 Nov. 14, 2019

(30) Foreign Application Priority Data

Sep. 29, 2016 (EP) ..... 16191364

(51) Int. Cl.
*C21D 7/04* (2006.01)
*B21B 37/24* (2006.01)
*B21B 1/22* (2006.01)

(52) U.S. Cl.
CPC ..... *C21D 7/04* (2013.01); *B21B 37/24* (2013.01); *B21B 2001/221* (2013.01);
(Continued)

(58) Field of Classification Search
CPC ..... C21D 7/02; C21D 2211/001; C21D 2211/005; B21B 1/28; B21B 1/36;
(Continued)

(56) References Cited

U.S. PATENT DOCUMENTS 6,336,349 B1 1/2002 Hauger et al.
10,889,879 B2 * 1/2021 Sano ..... C22C 38/02
(Continued)

FOREIGN PATENT DOCUMENTS

DE 10041280 A1 3/2002
EP 1074317 A2 2/2001
(Continued)

OTHER PUBLICATIONS

Choi, Jeom Y. "Extended Strain Hardening by a Sequential Operation of Twinning Induced Plasticity and Transformation Induced Plasticity in a Low Ni Duplex Stainless Steel." Met. Mater. Int., vol. 20, No. 5 (2014), pp. 893-898 (Year: 2014).*

*Primary Examiner* — Adam J Eiseman
*Assistant Examiner* — Katie L. Parr
(74) *Attorney, Agent, or Firm* — The Webb Law Firm

(57) ABSTRACT

A method for partial hardening of an austenitic steel by utilizing during cold deformation the TWIP (Twinning Induced Plasticity), TWIP/TRIP or TRIP (Transformation Induced Plasticity) hardening effect. Cold deformation is carried out by cold rolling at least one surface of the steel with forming degree (Φ) of 5≤Φ≤60% in order to achieve in the steel at least two consecutive areas with different mechanical values in thickness, yield strength ($R_{p0.2}$), tensile strength (Rm) and elongation, having a ratio (r) between the ultimate load ratio (ΔF) and the thickness ratio (Δt) of 1.0>r>2.0, and in which the areas are mechanically connected to each other by a transition area having a thickness that is variable from the thickness of the first area in the
(Continued)

deformation direction to the thickness of the second area in the deformation direction.

21 Claims, 1 Drawing Sheet

(52) U.S. Cl.
CPC ..... *B21B 2201/02* (2013.01); *B21B 2271/02* (2013.01); *C21D 2211/001* (2013.01); *C21D 2211/005* (2013.01)

(58) Field of Classification Search
CPC . B21B 2201/02; B21B 2201/10; B21B 37/16; B21B 37/18; B21B 37/24; B21B 2261/04–05; B21B 2265/12; B21B 2265/18; B21B 2271/02
See application file for complete search history.

(56) References Cited

U.S. PATENT DOCUMENTS

| | | | | |
|---|---|---|---|---|
| 2002/0023472 | A1 | 2/2002 | Bohlke et al. | |
| 2006/0033347 | A1 | 2/2006 | Hauger et al. | |
| 2007/0163679 | A1* | 7/2007 | Fujisawa | C22C 38/58 148/325 |
| 2010/0304174 | A1 | 12/2010 | Wu et al. | |
| 2012/0070330 | A1* | 3/2012 | Ishii | C22C 38/50 420/73 |
| 2014/0223743 | A1* | 8/2014 | Frehn | C21D 8/10 29/897.2 |
| 2016/0122889 | A1 | 5/2016 | Muhr et al. | |
| 2016/0369382 | A1* | 12/2016 | Oliver | C22C 38/44 |
| 2017/0029918 | A1 | 2/2017 | Panier et al. | |
| 2017/0121797 | A1 | 5/2017 | Breuer et al. | |
| 2017/0326628 | A1* | 11/2017 | Choi | B22D 11/22 |
| 2017/0349983 | A1* | 12/2017 | Jin | C21D 8/0226 |
| 2018/0207695 | A1* | 7/2018 | Frohlich | B21C 37/02 |
| 2018/0223399 | A1 | 8/2018 | Palzer et al. | |
| 2019/0017134 | A1* | 1/2019 | Konberg | C21D 6/004 |
| 2019/0203311 | A1* | 7/2019 | Palzer | C22C 38/26 |

FOREIGN PATENT DOCUMENTS

| | | | | |
|---|---|---|---|---|
| EP | 2090668 | A1 | 8/2009 | |
| EP | 2924131 | A1 | 9/2015 | |
| GB | 2518444 | A * | 3/2015 | B21B 31/24 |
| WO | 2008068352 | A2 | 6/2008 | |
| WO | 2009095264 | A1 | 8/2009 | |
| WO | WO-2009095264 | A1 * | 8/2009 | C21D 7/13 |
| WO | 2014202587 | A1 | 12/2014 | |
| WO | 2015107393 | A1 | 7/2015 | |
| WO | 2017021464 | A1 | 2/2017 | |

* cited by examiner

METHOD FOR COLD DEFORMATION OF AN AUSTENITIC STEEL

CROSS-REFERENCE TO RELATED APPLICATIONS

This application is the United States national phase of International Application No. PCT/EP2017/074832 filed Sep. 29, 2017, and claims priority to European Patent Application No. 16191364.5 filed Sep. 29, 2016, the disclosures of which are hereby incorporated by reference in their entirety.

BACKGROUND OF THE INVENTION

Field of the Invention

The present invention relates to a method for cold deformation of an austenitic steel by utilizing during deformation the TWIP (Twinning Induced Plasticity), TWIP/TRIP or TRIP (Transformation Induced Plasticity) hardening effect in the steel in order to have in the deformed steel product areas having different values in mechanical and/or physical properties.

Description of Related Art

In transport system manufacturing, especially automotive car bodies and railway vehicles, engineers use arrangements to have the right material at the right place. Such possibilities are called "multi-material design" or "Tailored products" like flexible rolled blanks, which are metal products that prior to stamping features different material thicknesses along its length, and which can be cut to create a single initial blank. Flexible rolled blanks are applied in crash relevant components like pillars, cross and longitudinal members for automotive parts. Further, railway vehicles uses flexible rolled blanks in side walls, roofs or the connection parts, as well as buses and trucks also apply flexible rolled blanks. But in the prior art, "right material" for flexible rolled blanks means only to have the right thickness at the right place, because during the flexible rolling the mechanical properties, such as the tensile strength, will maintain at the same value as well as the ratio of the ultimate loads F as the product of the thickness, the tensile strength $R_m$ and the width of the material between the flexible rolled area and the unrolled area. Thus, it is not possible to create areas with different strength and ductility for a subsequent forming process. Usually a subsequent recrystallization annealing process and a galvanizing step follow to the origin flexible rolling or eccentric rolling process The DE patent application 10041280 and the EP patent application 1074317 are initial patents for flexible rolled blank in general. They describe a manufacturing method and equipment to manufacture a metal strip with different thicknesses. The way to reach that is to use an upper and a lower roll and to change the roll gap. However, the DE patent application 10041280 and the EP patent application 1074317 do not describe anything about an influence of the thickness to strength and elongation and about the correlation between strength, elongation and thickness. Furthermore, the required material for this relationship is not described, because no austenitic material is described.

The US publication 2006033347 describes flexible rolled blanks for the usage in a lot of automotive solutions as well as the way to use a sheet material with different thicknesses. Furthermore, the US publication 2006033347 describes the necessary sheet thickness curves which are meaningful for different components. But an influence to strength and elongation, a correlation between strength, elongation and thickness, as well as the required material for this relationship are not described.

The WO publication 2014/202587 describes a manufacturing method to produce automotive parts with a thickness variable strip. The WO publication 2014/202587 relates to the usage of press-hardenable martensitic low-alloyed steels like 22MnB5 for hot-forming solutions. But a relationship of mechanical-technological values to the thickness is not described as well as an austenitic material with the described special microstructure properties.

The object of the present invention is to eliminate drawbacks of the prior art and to achieve an improved method for cold deformation of an austenitic steel by utilizing during deformation the TWIP (Twinning Induced Plasticity), TWIP/TRIP or TRIP (Transformation Induced Plasticity) hardening effect of the austenitic steel in order to achieve areas in the austenitic steel product, which areas have different values in mechanical and/or physical properties.

SUMMARY OF THE INVENTION

In the method according to the present invention as a starting material it is used a hot or cold deformed strip, sheet, plate or coil made of an austenitic TWIP or TRIP/TWIP or TRIP steel with different thicknesses. The thickness reduction in the further cold deformation of the starting material is combined with a specific and balanced local change in the mechanical properties of the material, such as yield strength, tensile strength and elongation. The further cold deformation is carried out as flexible cold rolling or as eccentric cold rolling. The thickness of the material is variable along one direction particularly in the direction of the longitudinal extension of the material corresponding to the direction of cold deformation of the steel. Using the method of the invention the cold deformed material has the desired thickness and the desired strength at that part of the deformed product, where it is necessary. This is based on the creation of a relationship between strength, elongation and thickness. The present invention thus uses the benefits of a flexible or eccentric cold rolled material and solves the disadvantage of having only prior art homogeneous mechanical values over the complete deformed product.

DESCRIPTION OF THE INVENTION

Figure 1:
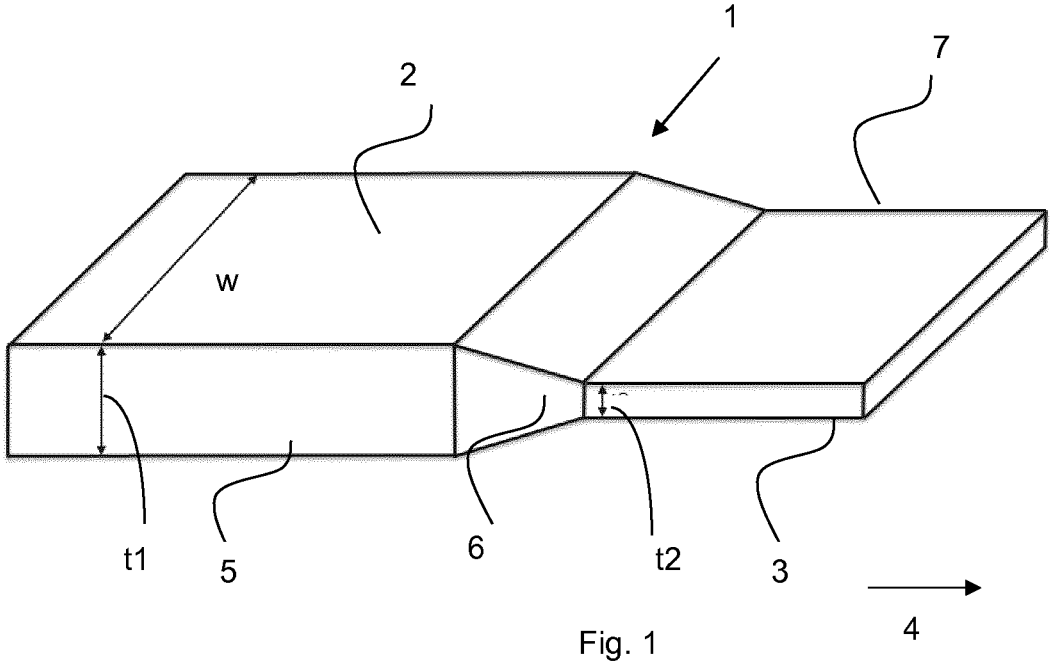
FIG. 1. shows a preferred embodiment of the present invention shown in schematic manner and seen as an axonometric projection.

In the method of the invention, a hot or cold deformed strip, sheet, plate or coil made of an austenitic TWIP or TRIP/TWIP or TRIP steel with different thicknesses is cold deformed by cold rolling in order to achieve at least two areas in the material with different specific relationships between thickness, yield strength, tensile strength and elongation in the longitudinal and/or transversal direction of the cold deformed material. The areas have a contact to each other advantageously through a longitudinal and/or transversal transition area between these areas. In the consecutive areas with different mechanical values before and after the transition area the ultimate load $F_1$ before deforming and the ultimate load $F_2$ after deforming for the material are determined with the formulas $$F_1=R_{m1}*w*t_1 \quad (1)$$

and $$F_2=R_{m2}*w*t_2 \quad (2)$$

where $t_1$ and $t_2$ are the thicknesses of the areas before and after cold rolling, the $R_{m1}$ and $R_{m2}$ are the tensile strengths of the areas before and after cold rolling and the w is the width of the material. Maintaining the material width w as a constant factor the ultimate load ratio ΔF in per cents between the thicknesses $t_1$ and $t_2$ is then $$\Delta F=(F_2/F_1)*100 \quad (3)$$

and respectively the thickness ratio Δt in per cents between the loads $F_1$ and $F_2$ is $$\Delta t=(t_2/t_1)*100 \quad (4).$$

The ratio r between ΔF and Δt is then $$r=\Delta F/\Delta t=R_{m2}/R_{m1} \quad (5)$$

Further, the ratio $r_\phi$ is determined between the ratio r and the forming degree ϕ in per cents with the formula $$r_\phi=(r/\phi)*100 \quad (6).$$

According to the invention the ratio r in the steel between the cold rolled area and the unrolled area is at the range of $1.0<r<2.0$, preferably $1.15<r<1.75$, and the ultimate load ratio ΔF between the thicknesses in the unrolled area and the cold rolled area in percent is more than 100%. Further, the forming degree Φ is at the range of $5\leq\Phi\leq60$, preferably $10\leq\Phi\leq40$, and the ratio rip is more than 4.0.

For a cold rolled material with different thicknesses according to the invention the maximum bearable load is designed for every thickness area. For a state of the art process with an annealed material the thickness is the only influencing variable taking into account that the width is constant over the whole coil and the tensile strength, too, because of the annealed condition. With different work hardening levels the tensile strength $R_m$ is in accordance with the invention and the second influencing variable and the formulas (1) and (2) can be transferred into the formula (5). The formula (3) shows with the force ratio of the different thickness areas and with the ratio r of formula (5) that it can be connected to the relation between thickness t and tensile strength $R_m$. For rolled materials manufactured with the present invention the ratio r should be between $1.0<r<2.0$, preferably between $1.15<r<1.75$. That means that for materials used in the present invention it is possible that lower thickness areas can bear a higher load. The influence of the increasing work-hardening exceeds the influence of the decreasing thickness. As a result of the present invention the value ΔF for formula (3) should be every time ≥100%.

A further way to describe the material manufactured with the present invention can be given with formula (6) where a relation between the material-specific forming degree ϕ and the ratio r from formula (5) is pointed out. The forming degree is a deformation parameter which in general describes the lasting geometrical changes of a component during the forming process. Therefore the relation of formula (6) can be used as an indication how much effort must be investigated to reach a further strength benefit. For the present invention $r_\varphi$ should be ≥4.0 otherwise the effort to get a better value for the load is uneconomic.

The cold deformed product in accordance with the invention can further be slitted into sheets, plates, slit strip or directly be delivered as a coil or strip. These half-finished products can be further processed as a tube or as another desired shape depending on the target of use.

The advantage of the present invention is that the cold deformed TWIP or TRIP/TWIP or TRIP steel combines areas of high strength in combination with a thickness reduction, and on the other side areas of a higher thickness with better ductility. Therefore, the present invention confines from other flexible rolled blank products of the prior art by combining the thickness reduction with a specific and balanced local change in the mechanical properties of the sheet, plate or coil by a cold rolling process. An energy-intensive and cost-intensive heat treatment like a press-hardening is thus not necessary.

With the present invention it is possible to achieve a flexible rolled or eccentric rolled material in a way that more ductile and thicker areas are locally available where material can thin-out and at the same time material can be hardened. On the other side there are high strength and thin areas for component areas like the bottom of a deep-drawing component where usually a hardening effect and thinning out cannot be realized because of too low deforming degree during the deep-drawing process.

The material which is useful to create the relationship between strength, elongation and thickness has the following conditions:

- steel with an austenitic microstructure and a TWIP, TRIP/TWIP or TRIP hardening effect,
- steel which is cold work hardened during their manufacturing,
- steel with manganese content between 10 and 25 weight %, preferably between 14 and 20 weight %,
- stainless steel which has the named microstructure effects and have a nickel content ≤4.0 weight %,
- steel which is defined alloyed with interstitial disengaged nitrogen and carbon atoms with a (C+N)-content between 0.4 and 0.8 weight %,
- TWIP steel with a defined stacking fault energy between 18 and 30 mJ/m$^2$, preferably between 20 and 30 mJ/m$^2$, which makes the effect reversible under retention of stable full austenitic microstructure,
- TRIP steel with the stacking fault energy 10-18 mJ/m$^2$.

The austenitic TWIP steel can be a stainless steel with more than 10.5 weight % chromium and characterized by the alloying system CrMn or CrMnN especially. Such an alloying system is further especially characterized in a way that the nickel content is low (0.4 weight %) to reduce material costs and creating non-volatile component costs over a multiple year production series. One advantageous chemical composition contains in weight % 0.08-0.30% carbon, 14-26% manganese 10.5-16% chromium, less than 0.8% nickel and 0.2-0.8% nitrogen.

An austenitic TRIP/TWIP stainless steel can be a stainless steel with the alloying system CrNi, such as 1.4301 or 1.4318, CrNiMn, such as 1.4376, or CrNiMo, such as 1.4401. Also ferritic austenitic duplex TRIP/TWIP stainless steels, such as 1.4362 and 1.4462 are advantageous for the method of the present invention.

The 1.4301 austenitic TRIP/TWIP stainless steel contains in weight % less than 0.07% carbon, less than 2% silicon, less than 2% manganese, 17.50-19.50% chromium, 8.0-10.5% nickel, less than 0.11% nitrogen, the rest being iron and evitable impurities occurred in stainless steels. The 1.4318 austenitic TRIP/TWIP stainless steel contains in weight % less than 0.03% carbon, less than 1% silicon, less than 2% manganese, 16.50-18.50% chromium, 6.0-8.0% nickel, 0.1-0.2% nitrogen, the rest being iron and evitable impurities occurred in stainless steels. The 1.4401 austenitic TRIP/TWIP stainless steel contains in weight % less than 0.07% carbon, less than 1% silicon, less than 2% manganese, 16.50-18.50% chromium, 10.0-13.0% nickel, 2.0-2.5% molybdenum, less than 0.11% nitrogen, the rest being iron and evitable impurities occurred in stainless steels.

The 1.4362 ferritic austenitic duplex TRIP/TWIP stainless steel contains in weight % less than 0.03% carbon, less than 1% silicon, less than 2% manganese, 22.0-24.0% chromium, 4.5-6.5% nickel, 0.1-0.6% molybdenum, 0.1-0.6% copper, 0.05-0.2% nitrogen, the rest being iron and evitable impurities occurred in stainless steels. The 1.4462 ferritic austenitic duplex TRIP/TWIP stainless steel contains in weight % less than 0.03% carbon, less than 1% silicon, less than 2% manganese, 22.0-24.0% chromium, 4.5-6.5% nickel, 2.5-3.5% molybdenum, 0.10-0.22% nitrogen, the rest being iron and evitable impurities occurred in stainless steels.

Using austenitic stainless materials, a further surface coating is not necessary. In a case the material is used for a component for vehicles the standard cataphoretic painting of the car body is sufficient. That is especially for wet corrosion parts a benefit in point of costs, production complexity and corrosion protection a comprehensive advantage.

With a stainless TWIP or TRIP/TWIP steel it is further possible to avoid a subsequent galvanizing process after the flexible cold rolling process or eccentric cold rolling process. Referring to the well-known properties of stainless steels the final cold rolled material has increased properties in point of non-scaling and heat resistant. Therefore, the cold rolled materials of the invention can be used in high temperature solutions.

A benefit for full austenitic TWIP steels are the non-magnetic properties under conditions like forming or welding. Therefore, the full austenitic TWIP steels are suitable for the application as flexible rolled blanks in battery electric vehicle components.

The present invention describes a manufacturing method to roll different areas into a coil or strip, where The production width is $650 \leq t \leq 1600$ mm The initial thickness is $1.0 \leq t \leq 4.5$ mm Intermediate annealing during deformation and annealing after deforming can be used in order to get homogeneous material properties.

The component to be manufactured according to the invention

Is an automotive component, such as an airbag bush, an automotive car body component like a chassis-part, subframe, pillar, cross member, channel, rocker rail, Is a commercial vehicle component with a semi-finished sheet, tube or profile, Is a railway vehicle component with a continuous length 2000 mm like a side wall, floor, roof, Is a tube manufactured out of a strip or slit strip, is a automotive add-on part like a crash-relevant door-side impact beam, is a component with non-magnetic properties for battery electric vehicles, is a rollformed or hydroformed component for transportation applications.

In FIG. 1 a piece of TWIP material 1 is flexible cold rolled both on the upper surface 2 and on the lower surface 3 with the rolling direction 4. The material piece 1 has a first area 5 where the material is thick and the material is more ductile and at the same time hardened. The material piece further has a transition area 6 where the material thickness is variable so that the thickness is lowering from the first area 5 to the second area 7 where the material has higher strength, but lower ductile.

Figure 2:
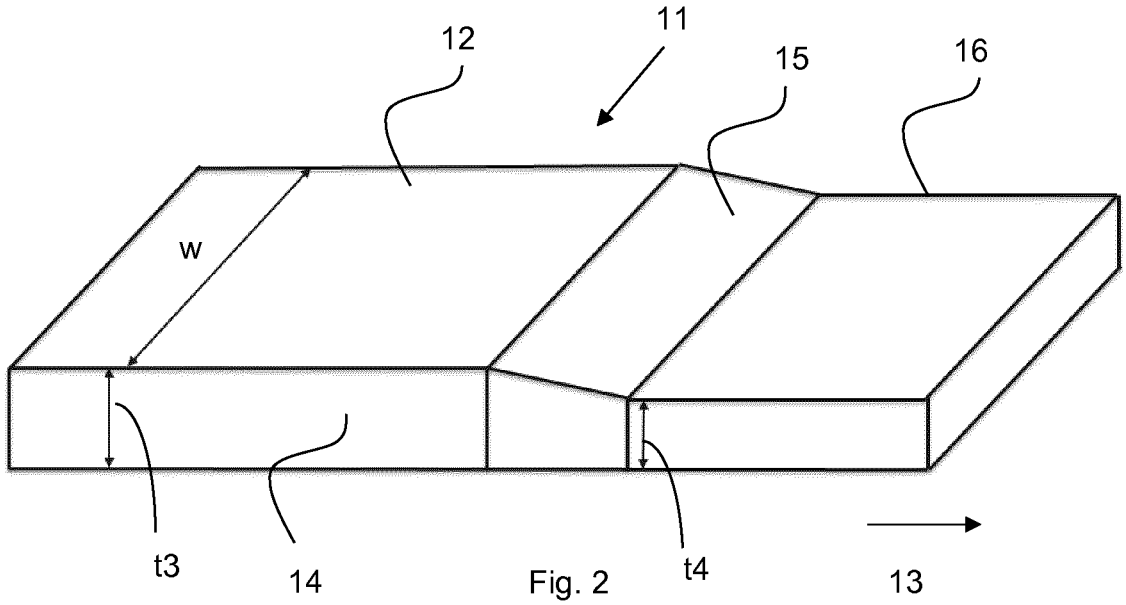
FIG. 2 shows another preferred embodiment of the present invention shown in schematic manner and seen as an axonometric projection.

In FIG. 2 a piece of TWIP material 11 is flexible cold rolled only on the upper surface 12 with the rolling direction 13. As in the embodiment of FIG. 1, the material piece 11 has a first area 14 where the material is thick and the material is more ductile and at the same time hardened. The material piece 11 further has a transition area 15 where the material thickness is variable so that the thickness is lowering from the first area 14 to the second area 16 where the material has higher strength, but lower ductile.

The method according to the present invention was tested with the TWIP (Twinning Induced Plasticity) austenitic steels which chemical compositions in weight % are in the following table 1.

TABLE 1

| Alloy | Cr | Mn | Ni | C | N |
|---|---|---|---|---|---|
| A (melt1) | 16 | 18 | ≤2 | 0.3 | 0.4 |
| B (melt2) | 14 | 15 | ≤2 | 0.3 | 0.6 |
| C (melt3) | 12 | 20 | ≤2 | 0.08 | — |
| D (melt4) | 6 | 14 | 0.5 | 0.08 | 0.2 |
| E (melt5) | 18 | 6 | 2.5 | 0.06 | — |

The alloys A-C and E are austenitic stainless steels, while the alloy D is an austenitic steel.

The measurements of yield strength $R_{p0.2}$, tensile strength $R_m$ and elongation $A_{80}$ for each alloy A-E were done before and after the flexible cold rolling where the alloys were rolled on both the upper surface and the lower surface. The results of the measurements as well as the initial thickness and the resulting thickness are described in the following table 2.

TABLE 2

| Alloy | Initial thickness mm | Initial yield strength MPa | Initial tensile strength MPa | Initial elongation A80 | Resulting thickness mm | Resulting yield strength MPa | Resulting tensile strength MPa | Resulting elongation A80 |
|---|---|---|---|---|---|---|---|---|
| A (melt1) | 2.0 | 520 | 965 | 51 | 1.6 | 1040 | 1280 | 13 |
| B (melt2) | 1.0 | 770 | 1120 | 33 | 0.9 | 1025 | 1250 | 14 |
| C (melt3) | 2.0 | 490 | 947 | 45 | 1.4 | 1180 | 1392 | 7 |
| D (melt4) | 1.6 | 380 | 770 | 41 | 1.3 | 725 | 914 | 14 |
| E (melt5) | 1.5 | 368 | 802 | 50 | 1.2 | 622 | 1090 | 15 |

The results in the table 2 show that the yield strength $R_{p0.2}$ and the tensile strength $R_m$ increase essentially during the flexible rolling, while the elongation $A_{80}$ decreases essentially during the flexible rolling.

The method according to the present invention was also tested with the TRIP (Transformation Induced Plasticity) or TRIP/TWIP austenitic or ferritic austenitic duplex standardized steels which chemical compositions in weight % are in the following table 3.

TABLE 3

| Grade | Cr | Mn | Ni | C | Mo | N |
|---|---|---|---|---|---|---|
| 1.4301 | 18 | 1.2 | 8.0 | 0.04 | — | — |
| 1.4318 | 17 | 1.0 | 7.5 | 0.02 | — | 0.14 |
| 1.4362 | 22 | 1.3 | 3.8 | 0.02 | — | 0.10 |
| 1.4401 | 17 | 1.2 | 10.5 | 0.02 | 2.2 | — |
| 1.4462 | 22 | 1.4 | 5.8 | 0.02 | 3.0 | 0.17 |

In the table 3 the grades 1.4362 and 1.4462 are ferritic austenitic duplex stainless steels, and the others 1.4301, 1.4318 and 1.4401 are austenitic stainless steels.

Before and after the flexible rolling, the mechanical values, yield strength $R_{p0.2}$, tensile strength $R_m$ and elongation, for the grades of the table 3 are tested, and the results with the initial thickness before the flexible rolling and the resulting thickness after the flexible rolling are described in the following table 4.

TABLE 4

| Grade | Initial thickness mm | Initial yield strength MPa | Initial tensile strength MPa | Initial elongation A80 | Resulting thickness mm | Resulting yield strength MPa | Resulting tensile strength MPa | Resulting elongation A80 |
|---|---|---|---|---|---|---|---|---|
| 1.4301 | 2.0 | 275 | 680 | 56 | 1.4 | 900 | 1080 | 12 |
| 1.4318 | 2.0 | 390 | 735 | 47 | 1.4 | 905 | 1090 | 20 |
| 1.4362 | 2.0 | 550 | 715 | 31 | 1.4 | 1055 | 1175 | 5 |
| 1.4401 | 2.0 | 310 | 590 | 53 | 1.4 | 802 | 935 | 13 |
| 1.4462 | 2.0 | 655 | 825 | 32 | 1.2 | 1190 | 1380 | 5 |

The results in the table 4 show that beside the austenitic stainless TWIP steels also the duplex stainless TRIP or TWIP/TRIP steels with an austenite content more than 40 vol %, preferably more than 50 vol %, have high suitability for hardened areas in a flexible rolling process.

For the TWIP, TWIP/TRIP and TRIP steels in accordance with the invention it was tested the effect of the forming degree ϕ. The table 5 shows the results for low nickel austenitic stainless steel B of the table 1.

TABLE 5

| φ % | Rm [MPa] | t [mm] | F [Nmm] | ΔF % | r | $r_\varphi$ |
|---|---|---|---|---|---|---|
| 0 | 935 | 2 | 1870 | | | |
| 5 | 1020 | 1.9 | 1938 | 104 | 1.09 | 21.8 |
| 10 | 1080 | 1.8 | 1944 | 104 | 1.16 | 11.6 |
| 20 | 1340 | 1.6 | 2144 | 115 | 1.43 | 7.2 |
| 25 | 1410 | 1.5 | 2115 | 113 | 1.51 | 6.0 |
| 40 | 1650 | 1.2 | 1980 | 106 | 1.76 | 4.4 |
| 50* | 1800 | 1 | 1800 | 96 | 1.93 | 3.9 |
| 60* | 1890 | 0.8 | 1512 | 81 | 2.02 | 3.4 |

*Outside the invention

The table 6 shows the results for austenitic stainless steel 1.4318

TABLE 6

| φ % | Rm [MPa] | t [mm] | F [Nmm] | ΔF % | r | $r_\varphi$ |
|---|---|---|---|---|---|---|
| 0 | 715 | 2 | 1430 | | | |
| 10 | 800 | 1.8 | 1440 | 101 | 1.12 | 11.2 |
| 20 | 925 | 1.6 | 1480 | 103 | 1.29 | 6.5 |
| 25 | 990 | 1.5 | 1485 | 104 | 1.38 | 5.5 |
| 40 | 1280 | 1.2 | 1536 | 107 | 1.79 | 4.5 |
| 50 | 1440 | 1 | 1440 | 101 | 2.01 | 4.0 |
| 60* | 1565 | 0.8 | 1252 | 88 | 2.19 | 3.6 |

*Outside invention

The table 7 shows the results for duplex austenitic ferritic stainless steel 1.4362.

TABLE 7

| φ % | Rm [MPa] | t [mm] | F [Nmm] | ΔF % | r | $r_\varphi$ |
|---|---|---|---|---|---|---|
| 0 | 715 | 2 | 1430 | | | |
| 5 | 805 | 1.9 | 1530 | 107 | 1.13 | 22.5 |
| 10 | 900 | 1.8 | 1620 | 113 | 1.26 | 12.6 |
| 20 | 1080 | 1.6 | 1728 | 121 | 1.51 | 7.6 |
| 25 | 1125 | 1.5 | 1688 | 118 | 1.57 | 6.3 |

TABLE 7-continued

| φ % | Rm [MPa] | t [mm] | F [Nmm] | ΔF % | r | $r_\varphi$ |
|---|---|---|---|---|---|---|
| 40 | 1310 | 1.2 | 1572 | 110 | 1.83 | 4.6 |
| 50* | 1366 | 1 | 1366 | 96 | 1.91 | 3.8 |

*Outside the invention

The table 8 shows the results for duplex austenitic ferritic stainless steel 1.4462.

TABLE 8

| φ % | Rm [MPa] | t [mm] | F [Nmm] | ΔF % | r | $r_\varphi$ |
|---|---|---|---|---|---|---|
| 0 | 825 | 2 | 1650 | | | |
| 5 | 910 | 1.9 | 1729 | 105 | 1.10 | 22.1 |
| 10 | 1020 | 1.8 | 1836 | 111 | 1.24 | 12.4 |
| 20 | 1165 | 1.6 | 1864 | 113 | 1.41 | 7.1 |
| 25 | 1250 | 1.5 | 1875 | 114 | 1.52 | 6.1 |
| 40 | 1405 | 1.2 | 1686 | 102 | 1.70 | 4.3 |
| 50* | 1470 | 1 | 1470 | 89 | 1.78 | 3.6 |
| 60* | 1495 | 0.8 | 1196 | 72 | 1.81 | 3.0 |

*Outside invention

The table 9 shows the results for austenitic stainless steel 1.4301.

TABLE 9

| φ % | Rm [MPa] | t [mm] | F [Nmm] | ΔF % | r | $r_\varphi$ |
|---|---|---|---|---|---|---|
| 0 | 665 | 2 | 1330 | | | |
| 5 | 698 | 1.9 | 1326 | 100 | 1.05 | 21 |
| 10 | 760 | 1.8 | 1368 | 103 | 1.14 | 11.4 |
| 20 | 925 | 1.6 | 1480 | 111 | 1.39 | 6.95 |
| 25 | 1005 | 1.5 | 1508 | 113 | 1.51 | 6.05 |
| 40 | 1155 | 1.2 | 1386 | 104 | 1.74 | 4.34 |
| 50* | 1290 | 1 | 1290 | 97 | 1.94 | 3.88 |
| 60* | 1465 | 0.8 | 1172 | 88 | 2.20 | 3.67 |

*Outside the invention

The invention claimed is:

1. A method for partial hardening of an austenitic steel by utilizing during cold deformation a Twinning Induced Plasticity (TWIP), Twinning Induced Plasticity/Transformation Induced Plasticity (TWIP/TRIP) or Transformation Induced Plasticity (TRIP) hardening effect, wherein cold deformation is carried out by cold rolling at least one surface of the steel to be deformed with a forming degree (Φ) of 25≤Φ≤60% in order to achieve in the steel at least two consecutive areas with different mechanical values in thickness, yield strength ($R_{p0.2}$), tensile strength ($R_m$), and elongation, each of the consecutive areas has a ratio (r) between an ultimate load ratio (ΔF), which is an ultimate load ($F_2$) after deforming the area divided by an ultimate load ($F_1$) prior to deforming the area multiplied by 100, and a thickness ratio (Δt), which is a thickness ($t_2$) of the area after deforming the area divided by a thickness ($t_1$) of the area prior to deforming the area multiplied by 100, such that the ratio r is ΔF/Δt and r is 1.0<r<2.0, and the areas are mechanically connected to each other by a transition area having a thickness that is variable from a thickness of a first area in the deformation direction to a thickness of a second area in the deformation direction.

2. The method according to claim 1, wherein the cold rolling is carried out by flexible cold rolling.

3. The method according to claim 1, wherein the cold rolling is carried out by eccentric cold rolling.

4. The method according to claim 1, wherein the steel to be deformed is an austenitic TWIP steel.

5. The method according to claim 4, wherein the steel to be deformed is an austenitic stainless steel.

6. The method according to claim 1, wherein the steel to be deformed is a TRIP/TWIP steel.

7. The method according to claim 6, wherein the steel to be deformed is an austenitic duplex stainless steel.

8. The method according to claim 6, wherein the steel to be deformed is a ferritic austenitic duplex stainless steel containing more than 40 vol % austenite.

9. The method according to claim 1, wherein the steel to be deformed is a TRIP steel.

10. An automotive component comprising a cold rolled product manufactured according to claim 1.

11. A commercial vehicle component comprising a semi-finished sheet, tube, or profile comprising a cold rolled product manufactured according to claim 1.

12. A tube manufactured from a strip or slit strip comprising a cold rolled product manufactured according to claim 1.

13. A component with non-magnetic properties for battery electric vehicles comprising a cold rolled product manufactured according to claim 1.

14. A component for transportation applications comprising a cold rolled product manufactured according to claim 1, wherein the component is rollformed or hydroformed.

15. The method according to claim 6, wherein the steel to be deformed is a ferritic austenitic duplex stainless steel containing more than 50 vol % austenite.

16. The automotive component of claim 10, wherein the automotive component is an airbag bush or an automotive car body component.

17. The automotive component of claim 16, wherein the automotive car body component is a chassis-part, a sub-frame, a pillar, a cross member channel, a rocker rail, or a crash-relevant door-side impact beam.

18. A railway vehicle component with a continuous length≥2000 mm comprising a cold rolled product manufactured according to claim 1.

19. The railway vehicle component of claim 18, wherein the component comprises a side wall, a floor, or a roof.

20. A method for partial hardening of an austenitic steel by utilizing during cold deformation a Transformation Induced Plasticity (TRIP) hardening effect, wherein cold deformation is carried out by cold rolling at least one surface of the steel to be deformed with a forming degree (Φ) of 5≤Φ≤60% in order to achieve in the steel at least two consecutive areas with different mechanical values in thickness, yield strength ($R_{p0.2}$), tensile strength ($R_m$), and elongation, each of the consecutive areas has a ratio (r) between an ultimate load ratio (ΔF), which is an ultimate load ($F_2$) after deforming the area divided by an ultimate load ($F_1$) prior to deforming the area multiplied by 100, and a thickness ratio (Δt), which is a thickness ($t_2$) of the area after deforming the area divided by a thickness ($t_1$) of the area prior to deforming the area multiplied by 100, such that the ratio r is ΔF/Δt and r is 1.0<r<2.0, and the areas are mechanically connected to each other by a transition area having a thickness that is variable from a thickness of a first area in the deformation direction to a thickness of a second area in the deformation direction.

21. The method according to claim 20, wherein the forming degree (Φ) is $10 \leq \Phi \leq 40\%$ and the ratio (r) is $1.15 < r < 1.75$.

* * * * *